US011306980B2

(12) United States Patent
Tung et al.

(10) Patent No.: US 11,306,980 B2
(45) Date of Patent: Apr. 19, 2022

(54) HEAT SINK AND THERMAL DISSIPATION SYSTEM

(71) Applicants: Inventec (Pudong) Technology Corporation, Shanghai (CN); INVENTEC CORPORATION, Taipei (TW)

(72) Inventors: Kai-Yang Tung, Taipei (TW); Hung-Ju Chen, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 17/030,403

(22) Filed: Sep. 24, 2020

(65) Prior Publication Data

US 2022/0074680 A1 Mar. 10, 2022

(30) Foreign Application Priority Data

Sep. 8, 2020 (CN) ..... 202010932189.3

(51) Int. Cl.

| | |
|---|---|
| ***F28F 7/00*** | (2006.01) |
| ***F28F 3/02*** | (2006.01) |
| ***F28F 13/00*** | (2006.01) |
| ***F28F 21/08*** | (2006.01) |
| *F28D 21/00* | (2006.01) |

(52) U.S. Cl.

CPC ..... *F28F 3/025* (2013.01); *F28F 13/003* (2013.01); *F28F 21/085* (2013.01); *F28D 2021/0029* (2013.01); *F28F 2215/10* (2013.01)

(58) Field of Classification Search

CPC ..... F28F 3/025; F28F 13/003; F28F 21/085; F28F 2215/10; F28D 2021/0029

USPC ..... 165/80.2, 80.4, 104.33

See application file for complete search history.

(56) References Cited

U.S. PATENT DOCUMENTS 5,022,462 A * 6/1991 Flint ..... H01L 23/467 165/185
5,161,089 A * 11/1992 Chu ..... H01L 23/4338 257/E23.098
6,738,257 B1 * 5/2004 Lai ..... F28F 1/32 174/15.2
6,817,405 B2 * 11/2004 Kamath ..... H01L 23/3677 361/689
6,942,018 B2 * 9/2005 Goodson ..... F28D 15/00 174/15.1
7,078,803 B2 * 7/2006 Tilton ..... H01L 23/4735 361/698
7,139,172 B2 * 11/2006 Bezama ..... F28F 3/04 174/15.1
7,190,580 B2 * 3/2007 Bezama ..... F28F 13/06 174/15.1
7,230,334 B2 * 6/2007 Andry ..... H01L 23/473 257/713

(Continued)

*Primary Examiner* — Claire E Rojohn, III

(74) *Attorney, Agent, or Firm* — CKC & Partners Co., LLC

(57) ABSTRACT

A heat sink includes a bottom plate, a liquid barrier structure and a microstructure used for heat dissipation. The liquid barrier wall is arranged on the bottom plate. The liquid barrier wall is closed on the bottom plate to form a container. The microstructure for heat dissipation is arranged in the container and includes porous materials or 3D-structures with small sizes.

7 Claims, 7 Drawing Sheets

(56) References Cited

U.S. PATENT DOCUMENTS 7,450,386 B2 * 11/2008 Silverstein ..... H01L 23/427 174/15.1
2003/0024689 A1 * 2/2003 Nakahama ..... F28F 3/12 165/80.4
2003/0221813 A1 * 12/2003 Ritter ..... F28F 3/022 257/E23.098
2005/0082037 A1 * 4/2005 Thayer ..... F28F 13/003 257/E23.098
2006/0096738 A1 * 5/2006 Kang ..... F28F 3/022 257/E23.098
2007/0119571 A1 * 5/2007 Osawa ..... H01L 23/473 257/E23.098
2007/0121294 A1 * 5/2007 Campbell ..... F28F 9/007 165/80.4
2007/0124934 A1 * 6/2007 Peng ..... F28F 13/003 257/E23.098
2007/0204972 A1 * 9/2007 Edward ..... F28F 3/022 361/705
2007/0234565 A1 * 10/2007 Prociw ..... B22F 7/004 29/890.039
2008/0105413 A1 * 5/2008 Peng ..... F28F 13/185 165/104.33
2009/0050294 A1 * 2/2009 Fedorov ..... H01L 23/4735 165/80.3
2009/0294104 A1 * 12/2009 Lin ..... F28D 15/0233 165/104.26
2009/0308571 A1 * 12/2009 Thompson ..... H01L 23/467 165/104.34
2009/0326279 A1 * 12/2009 Tonkovich ..... B01F 25/431 422/198
2010/0314072 A1 * 12/2010 Lee ..... H01L 23/4924 165/185
2010/0326630 A1 * 12/2010 Wang ..... G06F 1/20 29/890.032
2012/0325437 A1 * 12/2012 Meyer, IV ..... F28D 15/0233 165/104.26
2013/0020059 A1 * 1/2013 Park ..... F28F 13/187 165/133
2016/0093788 A1 * 3/2016 Matsumoto ..... H01L 23/40 136/212
2016/0181170 A1 * 6/2016 Zhang ..... H05K 7/20009 165/80.2
2016/0209123 A1 * 7/2016 Yee ..... F28D 15/0233
2017/0234628 A1 * 8/2017 Frankiewicz ..... F28F 13/003 165/133
2017/0268835 A1 * 9/2017 Lin ..... F28F 13/04
2018/0045472 A1 * 2/2018 MacLellan ..... F28D 9/0031
2019/0003775 A1 * 1/2019 Lin ..... H05K 7/20409
2019/0003790 A1 * 1/2019 Hsieh ..... B28B 17/026
2019/0186842 A1 * 6/2019 Chiang ..... F28D 15/0266
2020/0023422 A1 * 1/2020 Lin ..... F28D 15/04
2020/0191496 A1 * 6/2020 Chiang ..... H05K 7/20436
2020/0232714 A1 * 7/2020 Lin ..... F28F 3/048
2021/0180873 A1 * 6/2021 Lin ..... H01L 23/427
2021/0278141 A1 * 9/2021 Qi ..... F28F 13/003

* cited by examiner

HEAT SINK AND THERMAL DISSIPATION SYSTEM

RELATED APPLICATIONS

This application claims priority to China Application Serial Number 202010932189.3, filed Sep. 8, 2020, which are herein incorporated by reference.

BACKGROUND

Field of Invention

The present invention relates to a heat sink and a thermal dissipation system.

Description of Related Art

For a single-phase or two-phase drop cooling system, the coolant flows through the heating element for heat exchange, or the coolant exchanges heat with the heat sink installed on the heat source to take away the heat. However, the surface of a heat source or a heat sink is usually smooth. For a two-phase system, the coolant has fewer nucleation points on the smooth surface, and the smooth surface is less likely to produce a boiling effect. In addition, since it is difficult to maintain the coolant close to the boiling point during coolant flows, it is very likely that the temperature of the coolant has not risen to the boiling point when it leaves the heating element. This keeps coolant in the cooling system in single-phase cooling, and the heat exchange efficiency is low.

Therefore, how to provide a solution for the mentioned problems is one of the subjects to be solved for the industry.

SUMMARY

To achieve the above object, an aspect of the present invention is related to a heat sink to improve the thermal dissipation efficiency.

One aspect of the present invention relates to a heat sink.

According to one embodiments of the present invention, a heat sink includes a bottom plate, a liquid barrier wall and a porous structure. The liquid barrier wall is arranged on the bottom plate. The liquid barrier wall surrounds the bottom plate to form a container. The porous structure is filled in the container formed by the liquid barrier wall.

In one or more embodiments of the present invention, the mentioned heat sink further includes a locking structure and an isolation wall. The locking structure is arranged upon the bottom plate and located within the container. The isolation wall is located on the bottom plate. The isolation wall is arranged between the locking structure and the porous structure.

In some embodiments, the locking structure is adjacent to the periphery of the container. The isolation wall is connected to the liquid barrier wall to form a closed chamber. The locking structure is located in the closed chamber.

In one or more embodiments of the present invention, the porous structure is a copper powder sintered metal.

One aspect of the present invention relates to a heat sink.

According to one embodiments of the present invention, a heat sink includes a bottom plate, a liquid barrier wall and a plurality of heat conducting fins. The liquid barrier wall is arranged upon the bottom plate. The liquid barrier wall is closed on the bottom plate to form a container. The heat conducting fins are arranged in the container. A plurality of microstructures is arranged on the bottom plate and the heat conducting fins. The microstructures are raised or recessed on the heat conducting fins and the bottom plate.

In one or more embodiments of the present invention, the heat conducting fins comprise a plurality of columnar heat conducting fins. A projection of each columnar heat conducting fin on the bottom plate is a circle.

In some embodiments, the columnar heat conducting fins are arranged on a plurality of straight rows in the liquid barrier wall, the straight rows extend in a first direction. The straight rows are arranged in a second direction.

In some embodiments, the straight rows include a first straight row and a second straight row. The first and second straight rows are two immediately-adjacent ones of the straight rows. A plurality of first columnar heat conducting fins of columnar heat conducting fins is arranged in the first straight row. A plurality of second columnar heat conducting fins of the columnar heat conducting fins is arranged in the second straight row. Any one of the first columnar heat conducting fins is not aligned with any of the second columnar heat conducting fins in the second direction.

One aspect of the present invention relates to a thermal dissipation system.

According to one embodiments of the present invention, a thermal dissipation system includes the mentioned heat sink and a coolant source. The heat sink is disposed on a heat source. The coolant source is arranged above the heat sink. The coolant source is used for dripping coolant toward the container of the heat sink.

In summary, by using a porous structure or forming a small-sized three-dimensional microstructure on the heat sink, the contact area of the coolant on the heat sink can be further increased, thereby improving the heat exchange efficiency, making the coolant easier to boil, and increasing the overall heat dissipation efficiency.

It is to be understood that both the foregoing general description and the following detailed description are by examples, and are intended to provide further explanation of the invention as claimed.

BRIEF DESCRIPTION OF THE DRAWINGS

In order to make the above and other objects, features, advantages, and embodiments of the present invention more comprehensible, the description of the drawings is as follows.

DETAILED DESCRIPTION

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in parts of embodiments of the present invention. Furthermore, for simplifying the drawings, some of the conventional structures and elements are shown with schematic illustrations. Also, the same labels may be regarded as the corresponding components in the different drawings unless otherwise indicated. The drawings are drawn to clearly illustrate the connection between the various components in the embodiments, and are not intended to depict the actual sizes of the components.

In addition, terms used in the specification and the claims generally have the usual meaning as each terms are used in the field, in the context of the invention and in the context of the particular content unless particularly specified. Some terms used to describe the invention are to be discussed below or elsewhere in the specification to provide additional guidance related to the description of the invention to specialists in the art.

The phrases "first," "second," etc., are solely used to separate the descriptions of elements or operations with the same technical terms, and are not intended to convey a meaning of order or to limit the invention.

Additionally, the phrases "comprising," "includes," "provided," and the like, are all open-ended terms, i.e., meaning including but not limited to.

Further, as used herein, "a" and "the" can generally refer to one or more unless the context particularly specifies otherwise. It will be further understood that the phrases "comprising," "includes," "provided," and the like used herein indicate the stated characterization, region, integer, step, operation, element and/or component, and does not exclude additional one or more other characterizations, regions, integers, steps, operations, elements, components and/or groups thereof.

Figure 1:
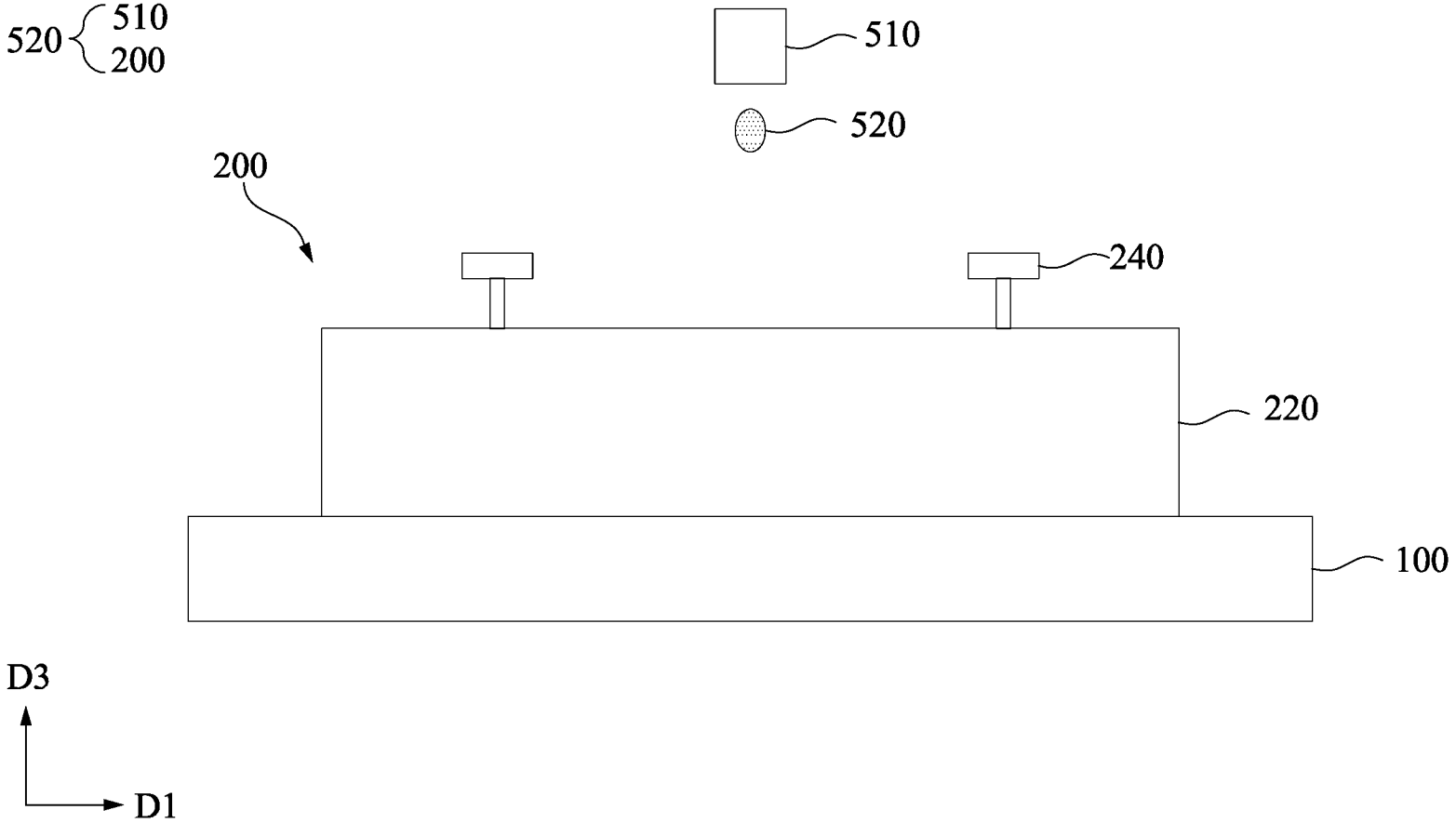
FIG. 1 illustrates a schematic view of a thermal dissipation system according to one embodiment of the present invention.

Reference is made by FIG. 1. FIG. 1 illustrates a schematic view of a thermal dissipation system 500 according to one embodiment of the present invention. In some embodiments of the present invention, the heat dissipation system 500 includes a heat sink 200 and a coolant source 510. The coolant source 510 drips the coolant 520 toward the heat sink 200. The coolant 520 receives the heat conducted by the heat sink 200 and has a phase changing to dissipate the heat, thereby exerting a heat dissipation effect. In some embodiments, the used coolant 520 is a cooling liquid with poor electrical conductivity, so as to avoid unexpected short circuits. For the specific structure of the heat sink 200, please refer to the subsequent FIGS. 2A and 2B. In some embodiments, the heat sink 200 in the heat dissipation system 500 can also be replaced by the heat sink 200' illustrated in FIG. 4A.

Figure 2A:
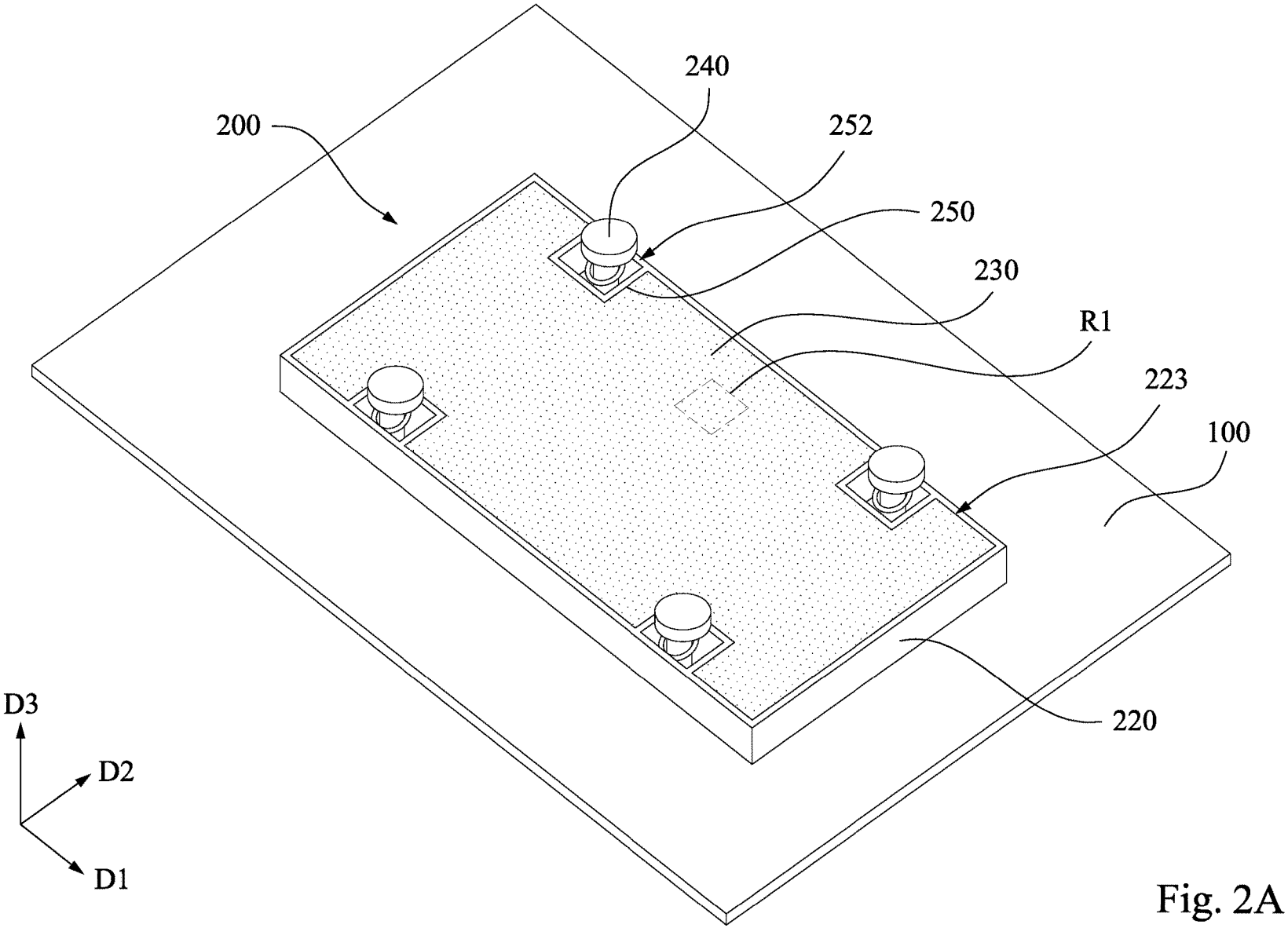
FIG. 2A illustrates a schematic view of a heat sink located on a heat source according to one embodiment of the present invention.
Figure 2B:
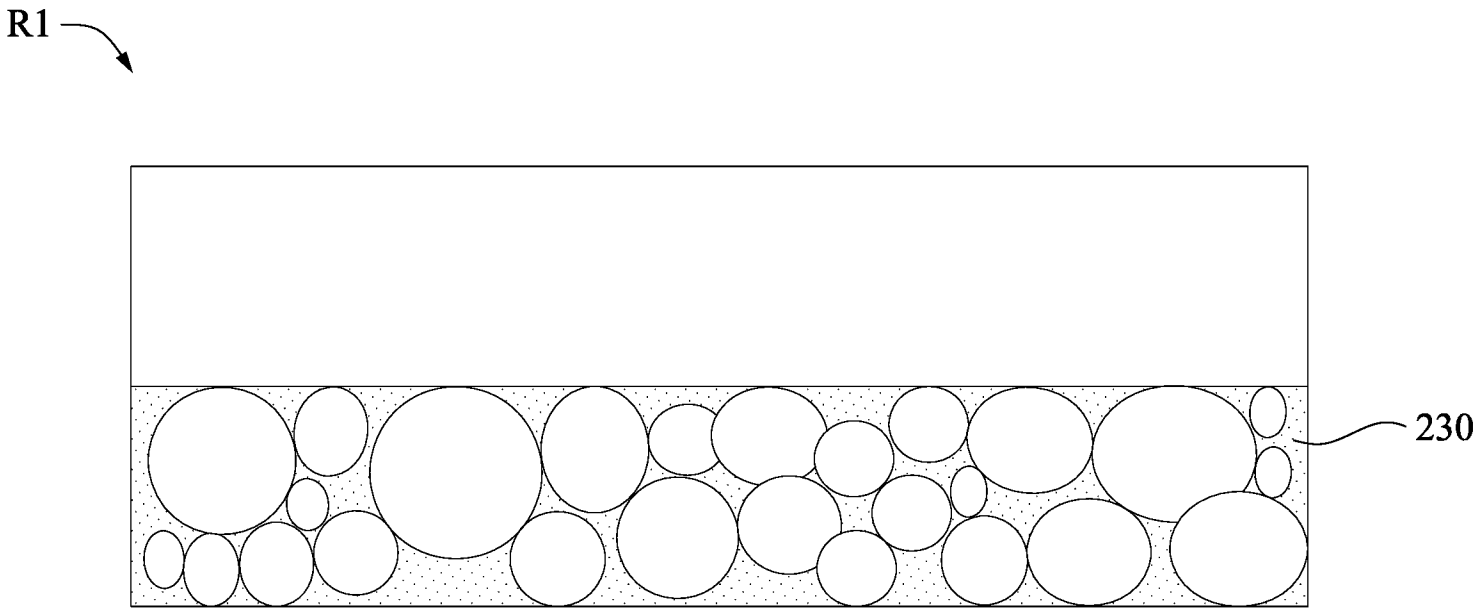
FIG. 2B illustrates a schematic local view of the heat sink of FIG. 2A according to one embodiment of the present invention.

Reference is made by FIGS. 2A and 2B. FIG. 2A illustrates a schematic view of a heat sink 200 located on a heat source according to one embodiment of the present invention. FIG. 2B illustrates a schematic local view of the heat sink 200 of FIG. 2A according to one embodiment of the present invention.

In some embodiments of the present invention, as shown in FIG. 2A, the heat sink 200 is located on the heat source 100. In some embodiments of the present invention, the heat source 100, which is a system to be cool, can be a component part of a computer or a server host. For the purpose of simple description, only one surface of the heat source 100 on which the heat sink 200 is illustrated in FIG. 1. In one embodiment of the present invention, the server host of the present invention can be used for artificial intelligence (AI) computing, edge computing, and can also be used as a 5G server, cloud server or used by the Internet of Vehicles server.

As shown in FIG. 2A, in this embodiment, the heat sink 200 is used for a droplet-cooling type heat dissipation system. The heat sink 200 is located on the heat source 100. The coolant can be dripped from the direction D3. After the heat sink 200 absorbs the heat generated by the heat source 100, the heat can be transferred to the coolant, so that the temperature of the coolant rises and has a phase changing. The heat generated by the heat source 100 can be dissipated by the phase changing of the coolant.

In this embodiment, the heat sink 200 includes a bottom plate (not shown in FIG. 2A), liquid barrier walls 220 and a porous structure 230. The liquid barrier walls 220 are located upon the bottom plate. The heat sink 200 is connected to the heat source 100 through the bottom plate. In some embodiments, the material of the bottom plate includes metal material with good thermal conductivity, so as to better conduct the heat generated by the heat source 100.

As shown in FIG. 2A, the liquid barrier wall 220 is a closed structure, and the closed liquid barrier wall 220 and the bottom plate form a container 223. Once the coolant is dripped onto the heat sink 200, the liquid barrier wall 220 can prevent the coolant from escaping from the heat sink 200 and keep the coolant in the container 223, and the coolant can receive the heat conducted by the heat sink 200 to have cooling effects.

Further, the container 223 can be used to fill a structure designed for heat dissipation. In this embodiment, the container 223 is filled with the porous structure 230. A schematic cross-sectional view of a part R1 of the porous structure 230 is shown in FIG. 2B.

In the cross-section of a part R1 of the porous structure 230 shown in FIG. 2B, the porous structure 230 includes a plurality of pores. These pores can further increase the contact area of the coolant and further improve the efficiency of heat exchange. In some embodiments, the porous structure 230 is made of metal with good thermal conductivity. For details, please refer to following discussion. As shown in FIG. 2B, the porous structure 230 fills the entire container 223 of the liquid barrier wall 220 of the heat sink 200, but the present invention is not limited to this example.

When the heat sink 200 is used for heat dissipation, the coolant can be dripped from the direction D3 into the container 223 formed by the liquid barrier wall 220 of the heat sink 200. Through the heat conduction of the porous structure 230, the porous structure 230 increases the contact area of the coolant and improves the heat dissipation efficiency.

Return to FIG. 2A. In this embodiment, the heat sink 200 is fixed to the heat source 100 by the locking structure 240. In this embodiments, the locking structures 240 are respectively adjacent the periphery of the container 223. In this embodiment, the locking structure 240 is, for example, a screw. Further, between the locking structures 240 and the porous structure 230, the heat sink 200 further includes isolation walls 250. In this embodiment, the locking structure 240 is located in the container 223 formed by the liquid barrier wall 220, and the locking structure 240 is adjacent to the edge of the container 223. In order to prevent the coolant dripping on the heat sink 200 from losing liquid through the locking structure 240, the isolation walls 250 and the liquid barrier wall 220 form an isolating chamber 252, thereby isolating the porous structure 230 and the locking structure 240 to prevent the coolant from flowing to gaps of the locking structure 240 and escaping.

Figure 3:
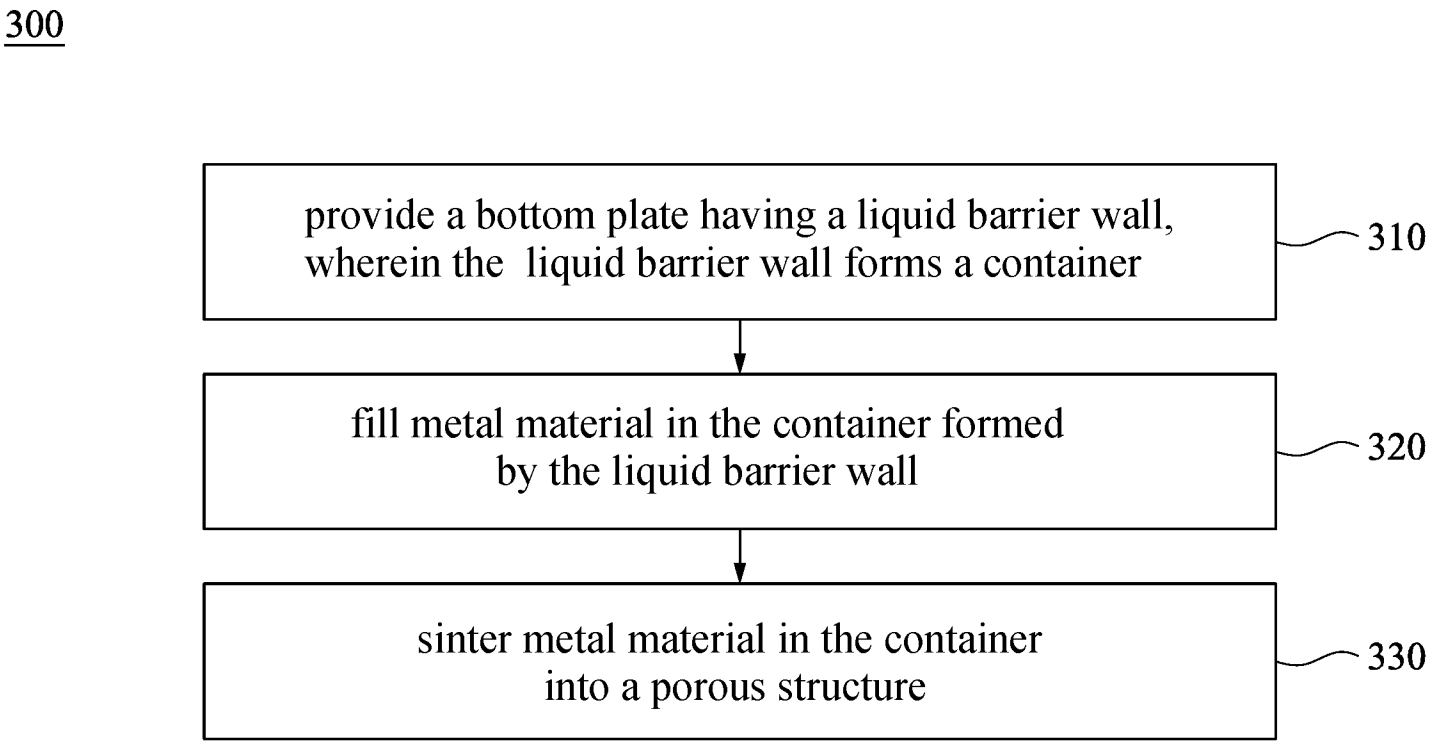
FIG. 3 illustrates a flow chart of a method for heat sink manufacturing according to one embodiment of the present invention.

FIG. 3 illustrates a flow chart of a method 300 for heat sink manufacturing according to one embodiment of the present invention. The method 300 includes operations 310, 320 and 330.

As shown in FIG. 3, in the operation 310, provide a bottom plate with a liquid barrier wall 220, wherein the closed liquid barrier wall 220 forms a container 223 on the bottom plate. In some embodiments, the locking structure 240 and the isolation wall 250 can also be formed in the container 223 first.

Subsequently, in operation 320, fill metal material in the container 223 formed by the liquid barrier wall 220. Specifically, the metal material filled into the container 223 includes copper metal powder with good thermal conductivity. The copper metal powder can be half-filled or completely filled in the container 223. In some embodiments, if the isolation chamber 252 formed by the locking structure 240 and the isolation wall 250 is provided in the container 223, and it is avoided to put the copper metal powder into the isolation chamber 252.

Continued with operation 320, in operation 330, sinter the metal material in the container 223 into the porous structure 230. In some embodiments of the present invention, the copper metal powder in the container 223 is heated through a sintering process to sinter the copper metal powder together with pores to form a porous structure 230, as shown in FIG. 2B. The porous structure 230 has multiple pores with different sizes, so as to increase the contact area of the coolant.

Figure 4A:
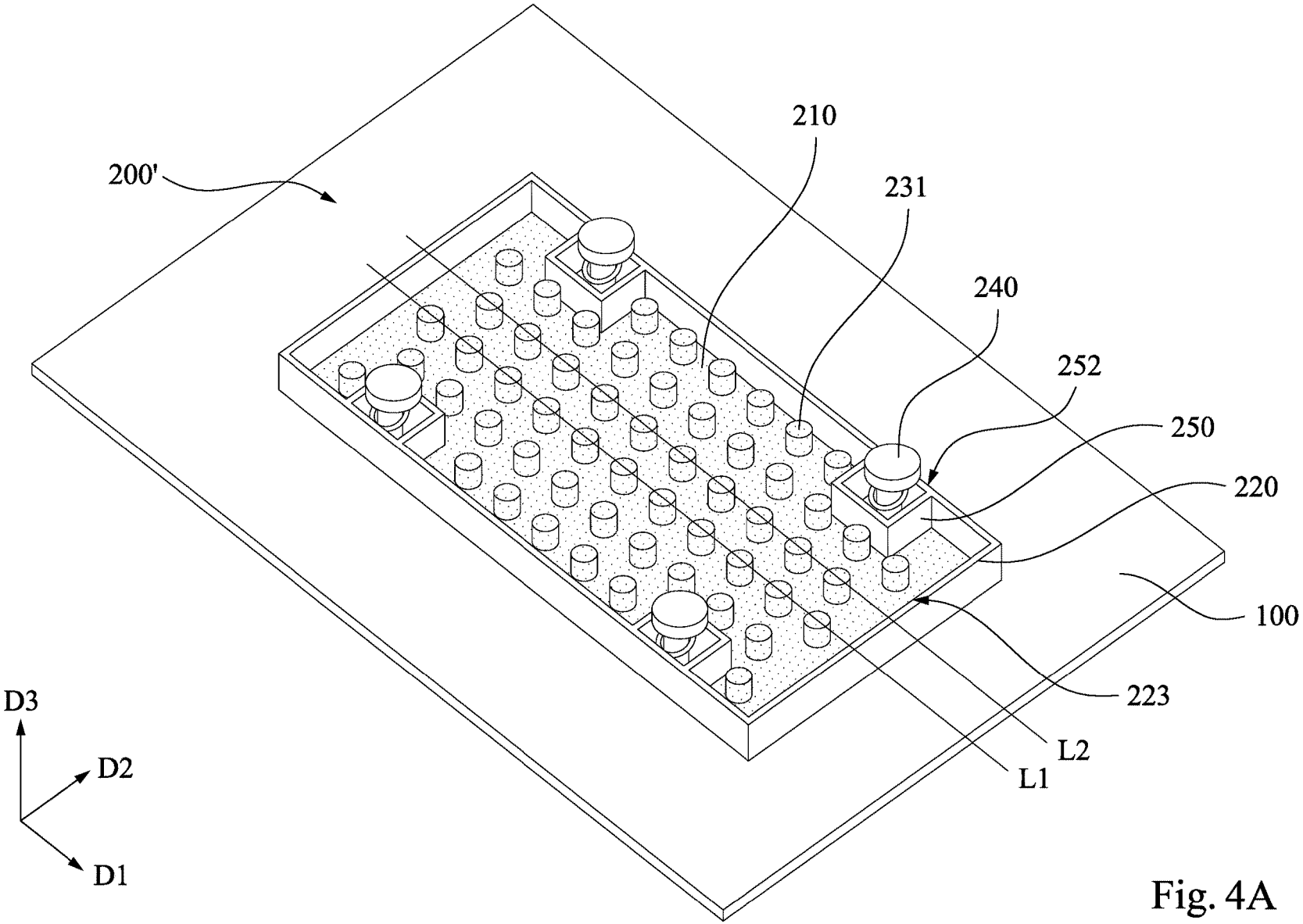
FIG. 4A illustrates a schematic view of a heat sink located on a heat source according to one embodiment of the present invention.
Figure 4B:
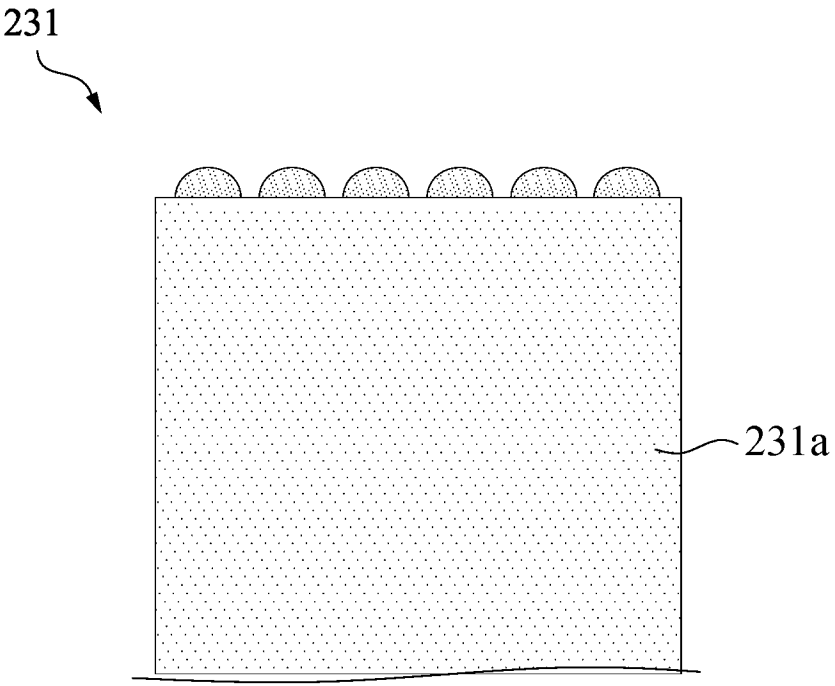
FIG. 4B illustrates a schematic local view of the heat sink of FIG. 4A according to one embodiment of the present invention.

FIG. 4A illustrates a schematic view of a heat sink 200' located on a heat source 100 according to one embodiment of the present invention. FIG. 4B illustrates a schematic local view of the heat sink 200' of FIG. 4A according to one embodiment of the present invention.

In some embodiments of the present invention, as shown in FIG. 4A, the heat sink 200' includes a bottom plate 210, a liquid barrier wall 220 and locking structures 240 and an isolation wall 250. The liquid barrier wall 220 is located upon the bottom plate 210 and forms a container 223. The heat sink 200' further includes columnar heat conducting fins 231. The shape of the columnar heat conducting fins 231 is cylindrical. A projection of each of the columnar heat conducting fins 231 on the bottom plate 210 is circular. Therefore, the flow resistance of the coolant on the heat sink 200' can be reduced, and the flow of the coolant can be facilitated to take away heat.

Through the closed liquid barrier wall 220, the coolant can be restricted to the top of the heat sink 200 or the heat sink 200', thereby increasing the heat exchange time between the coolant and the heat fin 200 or 200', so that the coolant can have phase changing to take away heat generated by hear source 100 as much as possible. The liquid barrier wall 220 can reduces the total amount of coolant required as a whole and reduces the cost of thermal dissipation system construction through maintaining the amount of coolant on the heat sink 200 or 200'. Through the liquid barrier wall 220, the coolant can quickly reach the boiling point. Therefore, the low-temperature coolant flowing out of the system is reduced, so that the system to be cool can have more heat removed to the outside.

In this embodiment, the direction D1 and the direction D2 are perpendicular to each other. Since the coolant droplets received by the heat sink 200' can move on the bottom plate 210 of the heat sink 200' in the directions D1 and D2, when the coolant droplets contact the columnar heat conducting fins 231, the smooth curved surfaces of the columnar heat conducting fins 231 have low flow resistance for the coolant droplet. The influence of the columnar heat conducting fins 231 on the flow velocity of the coolant drops can be reduced.

In some embodiments of the present invention, projection shapes of the columnar heat conducting fins 231 on the bottom plate 210 can include a perfect circle or an ellipse. In some embodiments, the projections of each of the columnar heat conducting fin 231 is elliptical such that the length of the columnar heat conducting fin 231 in the direction D1 and the direction D2 is different. For example, in some embodiments, the length of the columnar heat conducting fin 231 in the direction D1 is greater than the length of the columnar heat conducting fin 231 in the direction D2, and the columnar heat conducting fin 231 can guide the coolant droplets to move in the direction D1. The elliptical columnar heat conducting fins 231 can have lower flow resistance and reduce the influence of the coolant droplets on the heat sink 200'.

Further, in this embodiment, the columnar heat conducting fins 231 are arranged at intervals with the same interval d1 in the direction D1. As shown in FIG. 4A, the columnar heat conducting fins 231 are arranged in a plurality of straight rows in the direction D1. The straight rows extend in the direction D1. The straight are arranged in the direction D2 and parallel to each other. The two immediately-adjacent ones of the straight rows are spaced apart at the same interval d2. The straight rows include a first straight row L1 and a second straight row L2, which are to immediately-adjacent straight rows. The first straight rows L1 and the second straight row L2 are separated by the same interval d2, and the first straight rows L1 and the second straight row L2 are substantially offset from each other in the direction D2. Therefore, the columnar heat conducting fins 231 can play a role in guiding the coolant to flow uniformly on the bottom plate 210, thereby increasing the temperature uniformity and heat dissipation effect of the heat sink 200'.

As shown in FIG. 4A, in this embodiment, the heat sink 200' further includes microstructures located on the surface of the columnar heat conducting fins 231 and the bottom plate 210. It can be considered that the countable average roughness on the surface is greater than zero if the microstructures located on the surface. The surface of the columnar heat conducting fins 231 and the bottom plate 210 are no longer flat. The characteristics of the microstructures based on the uneven surface can help generate the nucleation point required for the coolant to boil when heated. In addition, the heat exchange area between the microstructures and the coolant can also enlarge. The average roughness greater than zero and enlarging heat exchange area contribute to the boiling phenomenon and phase change of the coolant.

FIG. 4B illustrates a schematic view of one of the columnar heat conducting fins 231 in FIG. 4A, and the microstructures located on a top surface of the columnar heat conducting fin 231. In some embodiments, as shown in FIG. 4B, the microstructures can be a plurality of protrusions on the surface of the column 231*a* of the columnar heat conducting fin 231. The protrusions are a small-sized three-dimensional microstructure raised on the column 231*a* of the columnar heat conducting fin 231, but not limit the shape of the microstructure of the present invention. For example, the small-sized three-dimensional microstructures on the surface of the columnar heat conducting fin 231 can be other types of uneven structures such as recesses on the surface of the column 231*a* of the columnar heat conducting fin 231, and the recesses can also be used to increase the heat exchange area between the coolant and the heat sink 200'. Through the microstructures, the nucleation point required for the boiling of the coolant is increased, and the boiling of the coolant is promoted. The enlarging surface area of the microstructure increases the heat exchange area with the coolant and improves the heat exchange efficiency.

Accordingly, the amount of the used coolant can be effectively reduced, and the construction cost of a droplet cooling system can also be reduced. The heat sink 200 or the heat sink 200' is subsequently can reduce the possibility that the coolant has not reached the boiling point or the heat exchange efficiency with the outside is low.

Figure 5:
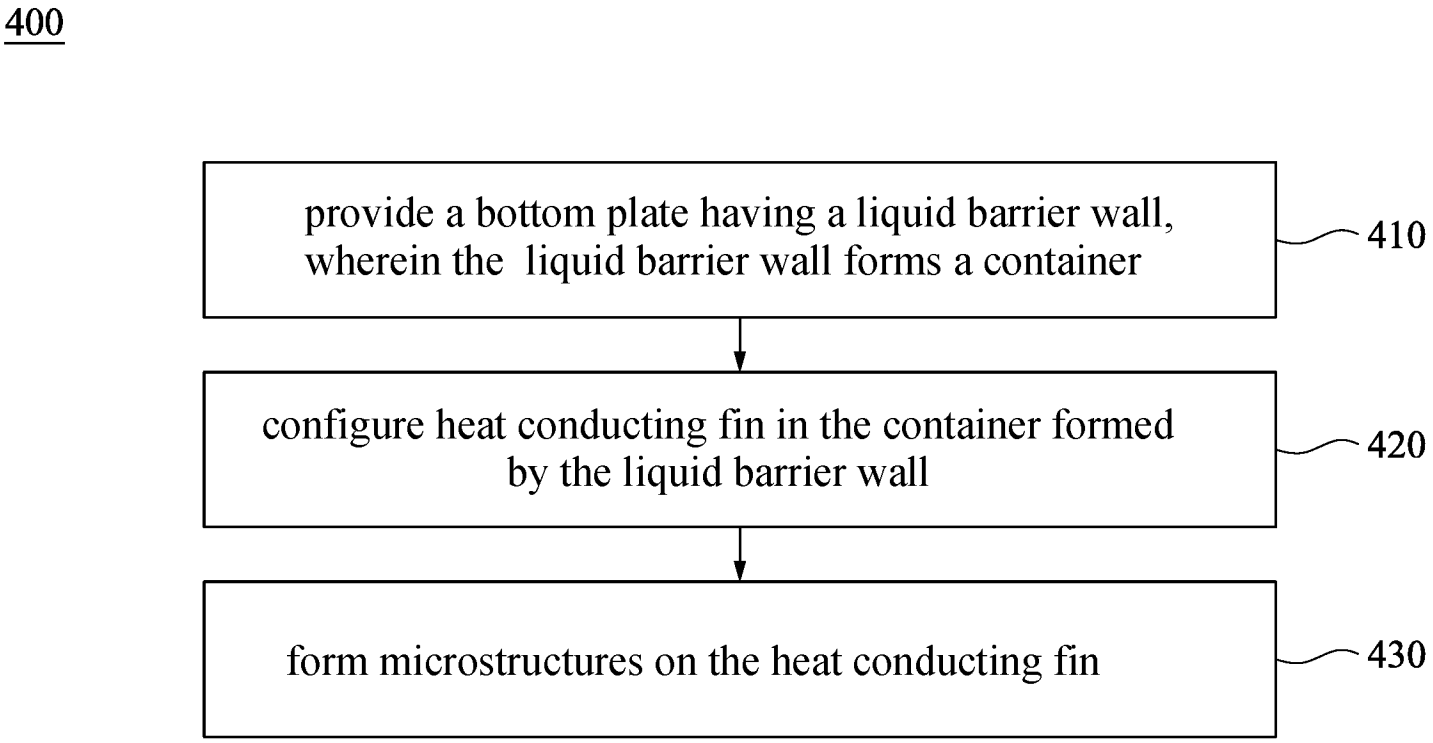
FIG. 5 illustrates a flowchart of a method of heat sink manufacturing according to one embodiment of the present invention.

FIG. 5 illustrates a flowchart of a method 400 of heat sink manufacturing according to one embodiment of the present invention. The method 400 includes operations 410, 420 and 430.

In the operation 410, provide a bottom plate 210 having a liquid barrier wall 220 is provided, wherein the closed liquid barrier wall 220 forms a container 223 on the bottom plate 210. In some embodiments, the locking structure 240 and the partition wall 250 can also be formed in the container 223 first.

Proceed to operation 420, configure a plurality of cylindrical columnar heat conducting fin 231 in the container 223 formed by the liquid barrier wall 220. Subsequently, in operation 430, form microstructures on the heat conducting fins 231. It should be noted that although some embodiments of the present invention use cylindrical columnar thermally conductive fins 231, the shapes of the heat conducting fins 231 are not limited. In some embodiments, sheet-shaped heat conducting fin 231 can also be used.

In some embodiments, similar to the method 300, the columnar heat conducting fins 231 and the bottom plate 210 are sprayed with copper metal powder, and then sintered on the surface of the columnar heat conducting fins 231 and the bottom plate 210 to produce porous structure. In some embodiments, the copper metal powder can be fixed on the surface of the columnar heat conducting fins 231 and the bottom plate 210 by heating to form convex microstructures.

In some embodiments, after the columnar heat conducting fins 231 are formed in the operation 420, the surface of the columnar heat conducting fins 231 and the bottom plate 210 can be processed by sandblasting or etching, so that the surface of the columnar heat conducting fins 231 and the bottom plate 210 have uneven microstructures.

In one embodiment of the present invention, the system to be cool can be a server, and the server of the present invention can be used for artificial intelligence (AI). In some embodiments, the server can also be used as a 5G server, a cloud server, or a server for Internet of Vehicles.

Although the present invention has been described in considerable detail with reference to certain embodiments thereof, other embodiments are possible. Therefore, the spirit and scope of the appended claims should not be limited to the description of the embodiments contained herein. In view of the foregoing, it is intended that the present invention cover modifications and variations of this invention provided they fall within the scope of the following claims.

What is claimed is:

1. A heat sink used for a droplet-cooling type heat dissipation system, comprising:

a bottom plate;

a liquid barrier wall disposed upon and surrounding the bottom plate to form a container;

a porous structure filled in the container formed by the liquid barrier wall;

a locking structure disposed on the bottom plate and within the container;

an isolation wall disposed on the bottom plate; and a plurality of heat conducting fins disposed in the container, wherein a plurality of microstructures are disposed on the bottom plate and the heat conducting fins and the microstructures are raised on recessed from the heat conducting fins and the bottom plate, wherein the locking structure is adjacent to a periphery of the container, the isolation wall is connected to the liquid barrier wall to form a closed chamber, and the locking structure is disposed in the closed chamber.

2. The heat sink of claim 1, wherein the isolation wall is disposed between the locking structure and the porous structure.

3. The heat sink of claim 1, wherein the porous structure is a copper powder sintered metal.

4. A thermal dissipation system, comprising:

a heat sink being disposed on a heat source, wherein the heat sink comprises:

a bottom plate;

a liquid barrier wall disposed upon and surrounding the bottom plate to form a container;

a porous structure filled in the container formed by the liquid barrier wall;

a locking structure disposed on the bottom plate and within the container;

an isolation wall disposed on the bottom plate; and a plurality of heat conducting fins disposed in the container, wherein a plurality of microstructures are disposed on the bottom plate and the heat conducting fins and the microstructures are raised on recessed from the heat conducting fins and the bottom plate, wherein the locking structure is adjacent to a periphery of the container, the isolation wall is connected to the liquid barrier wall to form a closed chamber, and the locking structure is disposed in the closed chamber; and a coolant source disposed above the heat sink, wherein the coolant source is configured to drip coolant toward the container of the heat sink, wherein the coolant source drips the coolant toward the heat sink, the coolant receives the heat conducted by the heat sink and has a phase changing to dissipate the heat, thereby exerting a heat dissipation effect.

5. The heat sink of claim 1, wherein the heat conducting fins comprise a plurality of columnar heat conducting fins, and a projection of each of columnar heat conducting fins on the bottom plate is a circle.

6. The heat sink of claim 5, wherein the columnar heat conducting fins are disposed on a plurality of straight rows in the liquid barrier wall, the straight rows extend in a first direction, and the straight rows are disposed in a second direction.

7. The heat sink of claim 6, wherein the straight rows comprise a first straight row and a second straight row, the first and second straight rows are two immediately-adjacent ones of the straight rows, a plurality of first columnar heat conducting fins of columnar heat conducting fins is disposed in the first straight row, a plurality of second columnar heat conducting fins of the columnar heat conducting fins is disposed in the second straight row, and any one of the first columnar heat conducting fins is not aligned with any of the second columnar heat conducting fins in the second direction.

* * * * *